US008087660B2

(12) United States Patent
Spall et al.

(10) Patent No.: US 8,087,660 B2
(45) Date of Patent: Jan. 3, 2012

(54) SINGLE MOTOR DOCUMENT JOGGER/FEEDER

(75) Inventors: James Michael Spall, Commerce, MI (US); Johan P. Bakker, Brighton, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 168 days.

(21) Appl. No.: 12/176,804

(22) Filed: Jul. 21, 2008

(65) Prior Publication Data

US 2010/0013145 A1 Jan. 21, 2010

(51) Int. Cl.
*B65H 5/00* (2006.01)

(52) U.S. Cl. ..... 271/10.04; 271/264

(58) Field of Classification Search ..... 271/264, 271/10.04, 10.13, 147, 109, 126, 4.04, 117–118, 271/10.11, 177–188
See application file for complete search history.

(56) References Cited

U.S. PATENT DOCUMENTS

| | | | | | |
|---|---|---|---|---|---|
| 3,949,979 | A * | 4/1976 | Taylor et al. | ..... | 271/10.01 |
| 4,522,385 | A * | 6/1985 | Stefansson | ..... | 271/10.11 |
| 4,523,832 | A * | 6/1985 | Strutt et al. | ..... | 399/388 |
| 5,249,787 | A * | 10/1993 | Ifkovits | ..... | 271/6 |
| 5,624,109 | A * | 4/1997 | Tanaka | ..... | 271/10.13 |
| 5,678,814 | A * | 10/1997 | Yokoyama et al. | ..... | 271/9.05 |
| 5,755,435 | A * | 5/1998 | Fujiwara | ..... | 271/4.04 |
| 5,784,680 | A * | 7/1998 | Taruki | ..... | 399/374 |
| 6,135,442 | A * | 10/2000 | Hirata et al. | ..... | 271/116 |
| 6,168,147 | B1 * | 1/2001 | Nose et al. | ..... | 271/10.13 |
| 6,390,462 | B1 * | 5/2002 | Ouchi et al. | ..... | 271/109 |
| 6,533,263 | B2 * | 3/2003 | Tamura | ..... | 271/10.01 |
| 6,672,581 | B2 * | 1/2004 | Lee et al. | ..... | 271/164 |
| 7,422,205 | B2 * | 9/2008 | Akiyama et al. | ..... | 271/118 |
| 2002/0096817 | A1 * | 7/2002 | Miki | ..... | 271/10.11 |
| 2003/0116906 | A1 * | 6/2003 | Amamoto | ..... | 271/126 |
| 2007/0257424 | A1 * | 11/2007 | Okazaki | ..... | 271/264 |
| 2008/0018044 | A1 * | 1/2008 | Kim | ..... | 271/109 |
| 2009/0014943 | A1 * | 1/2009 | Sasaki | ..... | 271/10.09 |

* cited by examiner

*Primary Examiner* — Kaitlin Joerger
*Assistant Examiner* — Patrick Cicchino
(74) *Attorney, Agent, or Firm* — Honigman Miller Schwartz and Cohn LLP

(57) ABSTRACT

A compact, desktop document processor for use on a countertop is provided. A low-profile document feeding machine includes a feeder, a hopper, at least one processing device, and an output pocket. The apparatus further includes a reversible motor including a shaft, a first one-way clutch, a second one-way clutch, a nudger device, and a jogging device. The nudger device is drivingly connected to the motor through the first one-way clutch such that driving the motor in a forward direction drives the nudger device to urge a document from a document stack in the hopper into the feeder. The jogging device is drivingly connected to the motor through the second one-way clutch such that driving the motor in a reverse direction drives the jogging device to align the documents in the document stack prior to feeding.

42 Claims, 3 Drawing Sheets

SINGLE MOTOR DOCUMENT JOGGER/FEEDER

BACKGROUND OF THE INVENTION

1. Field of the Invention

The invention relates to document processing, and to compact desktop document processors for capturing data and images from checks and other financial and payment-related documents. The invention further relates to document processors designed for processing documents at a teller window, and to document processors designed for processing documents at a back counter or a back office.

2. Background Art

Document processing machines function best when the documents are introduced into them in a consistent way. The leading edge and bottom edge of the documents are used to reference the location of items of interest on the documents. It is common industry practice to require the alignment of document leading and bottom edges before introducing them into the document processing machine. This process is known as jogging.

Various mechanical approaches have been used to obtain the jogging function, as will be familiar to those of ordinary skill in the art of document processing. These approaches have included electromagnetic actuators, motor-driven approaches using eccentric weights and/or linkages, and others. The working effect of all these approaches, however, has been very much the same—to temporarily separate a stack of documents from each other so that interdocument friction is reduced as far as possible, and then provide alignment surfaces that the documents can fall against under the influence of gravity. That is, these machines take a quantity of documents and repeatedly apply an accelerating impulse to the documents, having the effect of throwing them into the air just far enough that they will separate from each other, then allow them to fall on registration surfaces so as to align the desired edges of the documents. If the process is repeated often enough, all of the documents will eventually come to be aligned to the reference surfaces.

Historically, banks processed large volumes of paper checks in centralized locations, either a central bank or a clearing house. Document processing machines in such locations were large, processing up to 2000 documents per minute. These machines were supported by dedicated, trained operators. These machines were further supported by other machines known as document joggers. The document joggers vibrated stacks of documents into alignment before introduction into the document processing machines. Document joggers were typically relatively heavy, in order to provide sufficient reaction mass to vibrate the documents. As vibrating machines, document joggers were also objectionably loud.

The centralized processing of documents was beneficial to document processing machines, because of the dedicated operators and document joggers. However, centralized processing costs banks typically three days in clearing a document. The "Check Clearing for the 21st Century Act" or the "Check 21 Act" was enacted by Congress to facilitate check truncation by authorizing substitute checks, to foster innovation in the check collection system without mandating receipt of checks in electronic form, and to improve the overall efficiency of the Nation's payments system. The Check 21 legislation has driven the demand for decentralized check imagers and sorters in financial institutions. Check 21 gives equal legal validity to electronic data obtained from documents, and has made it possible for banks to distribute document processing to speed the clearing process.

Distributed processing poses problems for the document processing machines. The operators are no longer dedicated, but typically tellers with a number of other responsibilities, and less understanding of document preparation. The document processors are physically smaller, less expensive by orders of magnitude, and greater in number. Document joggers typically do not exist in the distributed environment, because of their size, noise, and cost.

For the foregoing reasons, there is a need for an improved document processor that is able to provide document preparation analogous to the jogging function at minimal cost, without operator intervention.

SUMMARY OF THE INVENTION

In one embodiment of the invention, a compact, desktop document processor for use on a counter-top is provided. A low-profile document feeding machine includes a feeder, a hopper, at least one processing device, and an output pocket. The apparatus further includes a reversible motor including a shaft, a first one-way clutch, a second one-way clutch, a nudger device, and a jogging device. The nudger device is drivingly connected to the motor through the first one-way clutch such that driving the motor in a forward direction drives the nudger device to urge a document from a document stack in the hopper into the feeder. The jogging device is drivingly connected to the motor through the second one-way clutch such that driving the motor in a reverse direction drives the jogging device to align the documents in the document stack prior to feeding.

In another embodiment, the nudger device and jogging device are composed of an arm, a nudger, and a spring-loaded flag. The arm has a first end mounted via the second one-way clutch to the motor shaft, and has a second end. The nudger is mounted to the second end of the arm, and is drivingly connected to the motor through the first one-way clutch such that driving the motor in the forward direction drives the nudger to urge a document from the document stack in the hopper into the feeder. The spring-loaded flag urges the document stack against the nudger. Driving the motor in the reverse direction drives the arm to cause the nudger to impact the document stack to jog the documents.

In another embodiment, the apparatus further comprises a third one-way clutch. The feeder is drivingly connected to the motor through the third one-way clutch such that driving the motor in the forward direction drives the feeder.

DETAILED DESCRIPTION OF THE PREFERRED EMBODIMENTS

Figure 1:
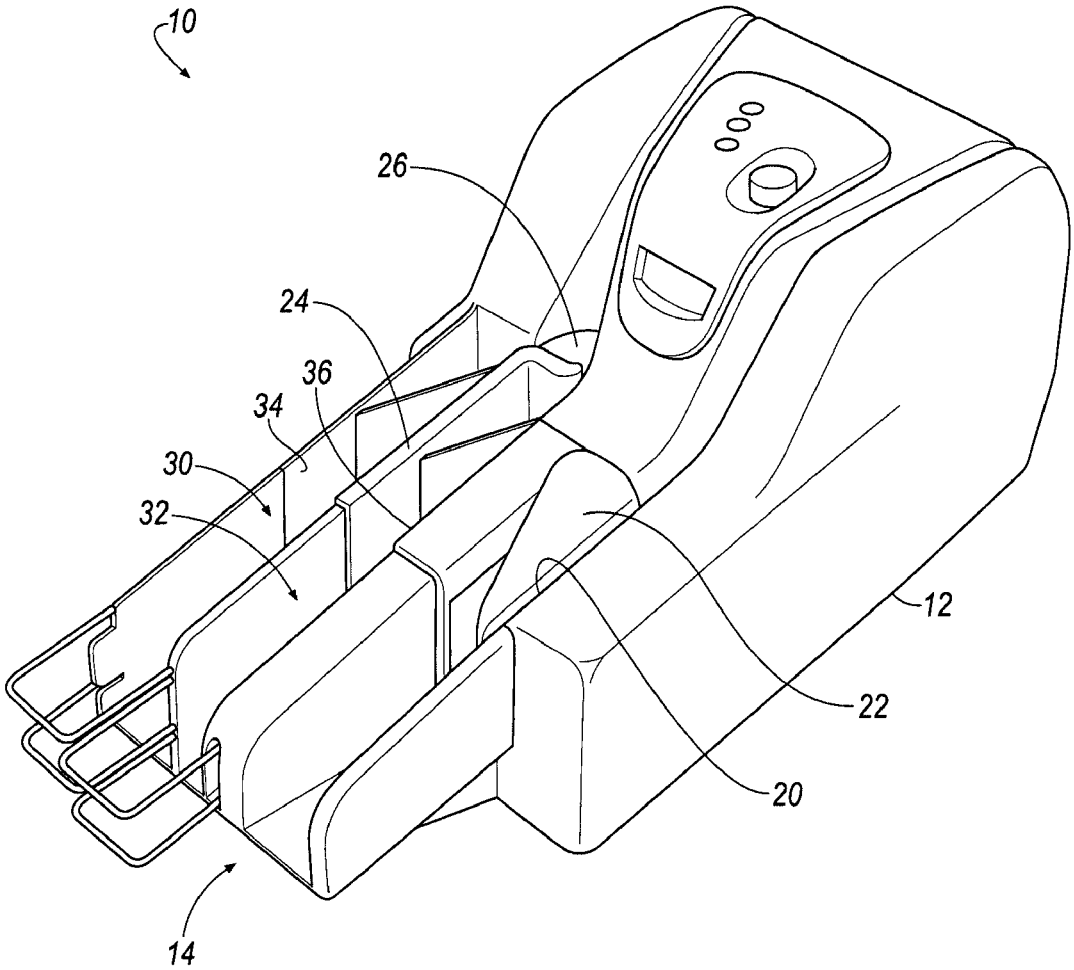
FIG. 1 illustrates a compact, desktop document processor in an embodiment of the invention.

As shown in FIG. 1, a compact, desktop document processor is generally indicated at 10. The apparatus 10 includes base unit 12, and input hopper 14 for receiving a batch of checks to be processed. In general, apparatus 10 is used for decentralized document processing applications. The input hopper 14 provides the operator with an area to place a stack of documents to be processed, supports longer documents, and assists with document alignment.

The apparatus 10 may be constructed to perform any number of known document processing actions as appreciated by one of ordinary skill in the art. Suitable electronics and mechanical mechanisms are located within base unit 12. For example, apparatus 10 may perform front and rear image capture, magnetic ink character recognition (MICR) reading, optical character recognition (OCR) reading, endorsing, and/or bar code reading depending on the application. Advantageously, the electronics and mechanical mechanisms required for the document processing actions are provided within base unit 12 as readily understood by one of ordinary skill in the art. The apparatus may be provided with a suitable network connection interface such as Ethernet or Universal Serial Bus (USB).

Input hopper 14 is an automatic, hands-off device that will feed a batch of checks into the base unit 12. Input hopper 14 receives and holds a batch of checks between side wall portion 20 and spring-loaded flag 22 which presses up against the last document in the loaded batch to keep the checks together. It is appreciated that apparatus 10 is suitable for processing checks as well as other financial and payment-related documents.

Divider element 24 includes a pocket selector 26 that allows checks to be sorted into, as shown, two pockets based on criteria such as high value amounts, image quality, reader rejects, and others. The pockets include first and second pockets 30 and 32, respectively. First pocket 30 is bound by side wall 34 of input hopper 14, and divider element 24. Second pocket 32 is bound by divider element 24 and wall 36.

Figure 2:
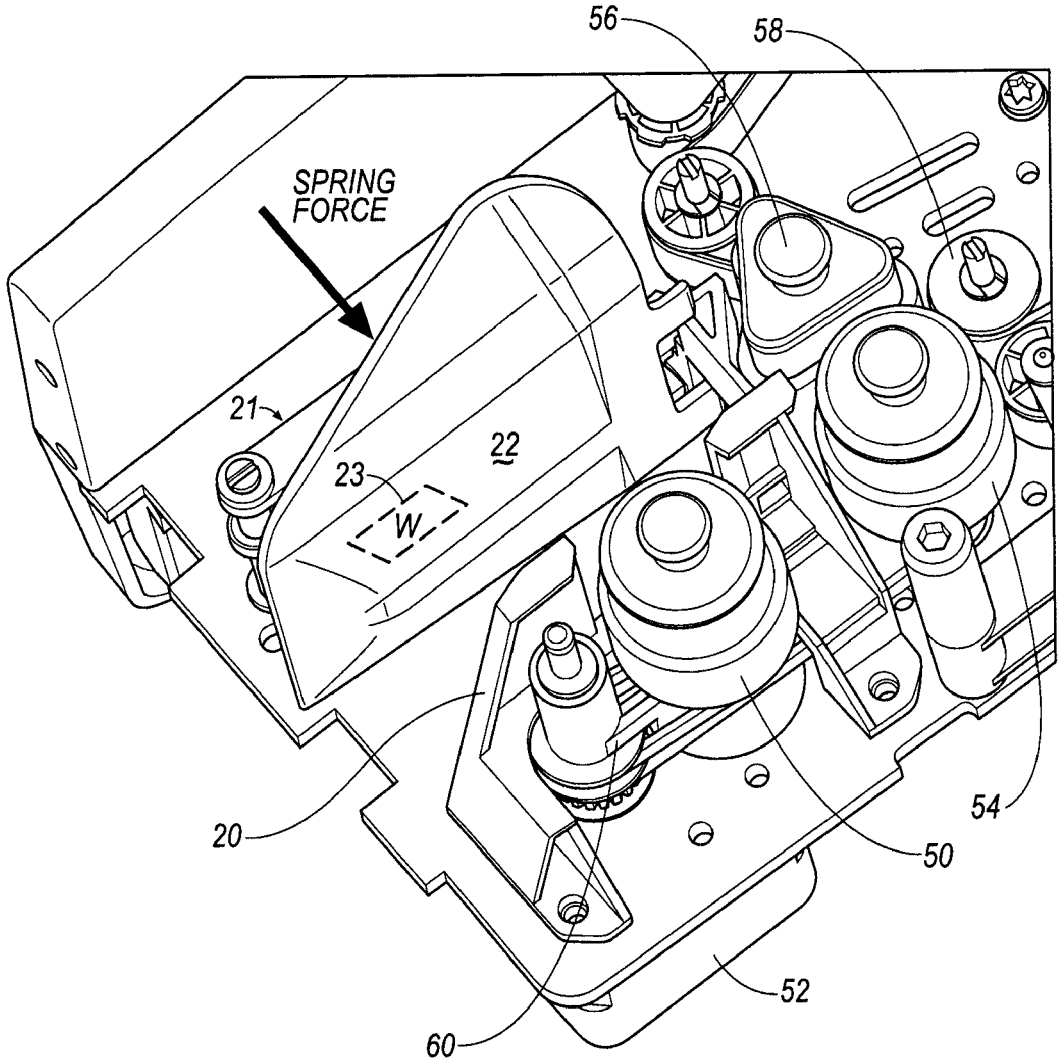
FIG. 2 illustrates a single motor jogger/feeder in an embodiment of the invention.
Figure 3:
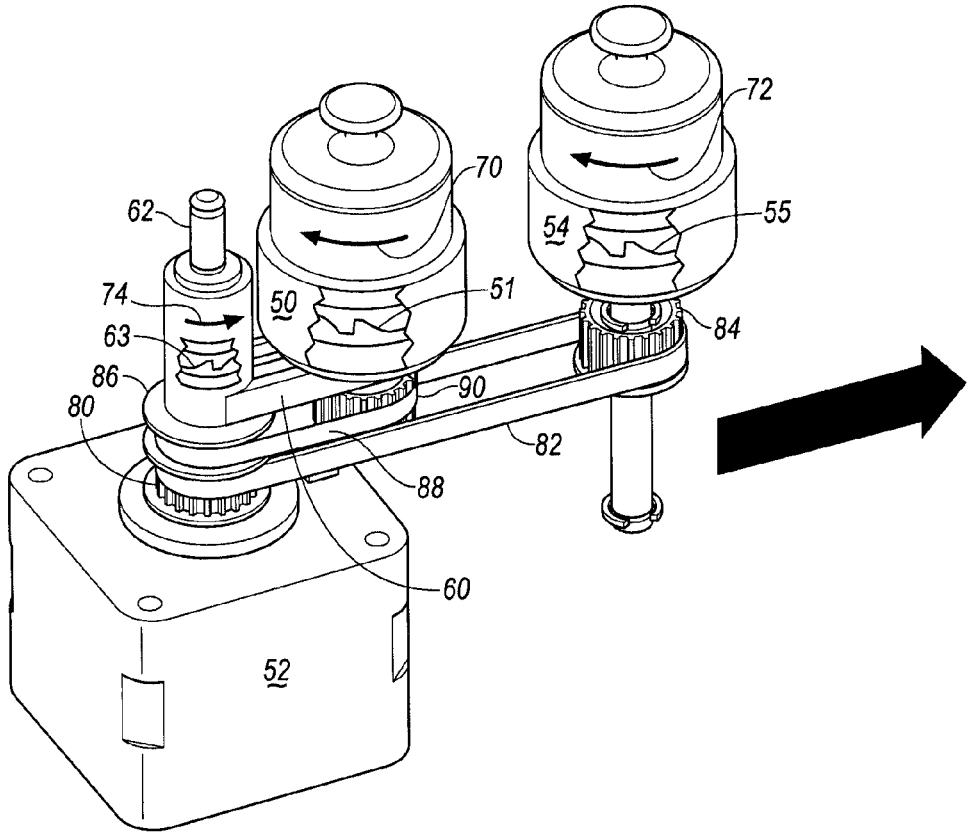
FIG. 3 illustrates a more detailed view of the single motor jogger/feeder.

Referring to FIG. 2, a more general view of an embodiment of the invention in a document processor is illustrated. FIG. 3 illustrates a more specific view.

The operator inserts documents to be processed between the flag 22 and the wall 20. A spring mechanism 21 associated with the flag 22 pushes the stack of documents against the nudger wheel 50 which is driven by the feed motor 52. The feed motor 52 is a stepper motor, which has excellent speed control and reversing capability. The nudger 50 moves documents forward to the pinch point between the feed wheel 54 and the separator 56. The separator 56 restrains subsequent documents such that the feed wheel 54 can only feed one document at a time into the transport 58.

It is necessary to create a gap between the documents being fed in order to identity and properly process the separate documents. In order to create a gap between the documents being fed, the feeder 54 runs at a slower linear speed than the transport 58. As the transport takes documents away at increased speed, gaps are created between the documents.

Because of the limited physical size of the document processors in a distributed environment, it is necessary to allow the documents being fed to accelerate to transport speed as soon as the document is in the transport section. This is before the document is completely out of the feeder. Therefore, the nudger and feed wheels 50 and 54, respectively, connect to their respective drive shafts through one-way clutches 51 and 55, respectively. These clutches release from their drive shafts when the document is pulled forward at increased speed by the transport 58.

An embodiment of the invention takes advantage of the readily reversible rotation of the feeder stepper motor 52 and an additional one-way clutch 63. As shown in FIG. 3, the arm 60 mounts to the feed motor shaft 62 via a one away clutch 63 mounted in the opposite sense to the one way clutches 51 and 55 in the nudger and feed wheels 50 and 54, respectively. That is, the one-way clutch 51 at nudger wheel 50 allows nudger wheel 50 to be driven in the direction indicated by arrow 70 and the one-way clutch 55 at feed wheel 54 allows feed wheel 54 to be driven in the direction indicated by arrow 72. The one-way clutch 63 at arm 60 allows arm 60 to be driven in the direction indicated by arrow 74.

In operation, after the operator has inserted documents between the flag 22 and the wall 20, the motor 52 would rotate in reverse (direction of arrow 74) momentarily. This would engage the one way clutch 63 in arm 60, driving the nudger wheel 50 rapidly toward the documents and forcing back flag 22. The motor would then rotate forward, returning arm 60 and nudger wheel 50 to their initial positions. In the time between being forced back by the nudger wheel 50 and being returned to their initial position by flag 22, the documents would be free to align their bottom edges on the document processor baseplate under the influence of gravity. This momentary process could be repeated multiple times if necessary to better prepare the documents. When the document preparation process was complete, motor 52 rotates forward, disengaging arm 60, engaging the nudger wheel 50 and feed wheel 54, and feeding documents into the transport 58.

As shown in FIG. 3, gear 80, driven by motor 52, is connected with belt 82 to gear 84 which drives feed wheel 54 through the one-way clutch 55 in the direction of arrow 72. Gear 86, driven by motor 52, is connected with belt 88 to gear 90 which drives nudger wheel 50 through the one-way clutch 56 in the direction of arrow 70. Shaft 62 drives arm 60 through the one-way clutch 63 in the direction of arrow 74. Thus, in operation of this embodiment, reverse driving of motor 52 will rotate arm 60 without rotating nudger wheel 50 and feed wheel 54. In turn, forward driving of motor 52 will rotate nudger wheel 50 and feed wheel 54 without rotating arm 60 but allowing arm 60 to return to its original position due to the force from the flag 22 (from the flag spring or other flag force providing arrangement as understood by those of ordinary skill in the art of document processing) transferred through the document stack to the arm 60 at nudger wheel 50.

A further improvement could be to weight the flag 22 (weight 23) in order to adjust its response to the action of arm 60. Making the flag heavier, given the same flag spring force, would cause the flag to return to its normal position more slowly, giving the documents additional time to align themselves.

As well, the number of arm strokes could be altered to provide the optimum balance between document alignment and preparation time. The number of arm strokes could be altered automatically, ultimately in response to document processor performance, or could be altered at the discretion of the operator (allowing the operator to apply the amount of jogging required based upon experience), or by a combination of both approaches.

A different, further improvement could be obtained by modulating the angular acceleration of arm 60, thus altering the impact upon and the reaction of flag 22 to the impulse applied to it. Those of ordinary skill in the art of document processing will understand that modulation of the arm impulse allows the effective alteration of both the amount and the duration of flag force reduction during each arm cycle.

In order to better appreciate some advantages associated with embodiments of the invention, consider some numbers relating to document jogging.

A personal check, by far the most common document processed, typically weighs 1 gram-force. To properly feed documents, they must be pressed against the nudger wheel with a force of about 100 gram-force. The friction of document against document is typically 0.5. That is, if two documents are pressed together with 100 gram-force, it would take 50 gram-force to slide one document relative to another. This creates an acceleration of 50 times gravity, or 50 g. Those of ordinary skill in the art will appreciate that to apply such accelerations to a typical stack of 100 documents pressed against the nudger wheel, weighing in total, 100 gram-force, will require a mechanism capable of applying peak forces in the range of 50 g×100 gram (5 kgf or approximately 11 lbf). This is typically considered greater than the weight of the entire machine in which such a mechanism would be contemplated to be included, which machine forms the only reaction mass against which such a mechanism would operate. Inclusion of such a mechanism capable of such forces into a machine of this size would result in a complete machine which would jump off the table on which it stands whenever the mechanism is actuated. Thus, embodiments of the invention have the advantage that such high peak forces are not required because the flag force is relieved.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A document processor for processing one or more documents, comprising:

a base unit forming a hopper; and a feeder-jogger assembly connected to the base unit, wherein the feeder-jogger assembly includes a motor, a shaft extending from and rotatably-connected to the motor, a first one-way clutch directly connected to the shaft, an arm having a first end and a second end, wherein the first end of the arm is directly mounted to the shaft via the first one-way clutch, a first gear directly connected to the shaft, a second gear directly connected to the shaft, a first belt having a first end and a second end, wherein the first end of the first belt is connected to the first gear, a third gear connected to the second end of the first belt, a nudger wheel disposed upon a first drive shaft and connected to the third gear, wherein the nudger wheel is directly connected to the first drive shaft by way of a second one-way clutch, a second belt having a first end and a second end, wherein the first end of the second belt is connected to the second gear, a fourth gear connected to the second end of the second belt, a feed wheel disposed upon a second drive shaft and connected to the fourth gear, wherein the feed wheel is directly connected to the second drive shaft by way of a third one-way clutch.

2. The document processor of claim 1, wherein the motor provides means for rotating the shaft in one of a forward direction, and a reverse direction, wherein the motor momentarily rotates the shaft in the reverse direction to result in the nudger wheel impacting the one or more documents within the hopper for aligning the one or more documents prior to a feeding of the one or more documents from within the hopper and past the feed wheel, wherein after the motor momentarily rotates the shaft in the reverse direction, the motor rotates the shaft in the forward direction to results in the nudger wheel feeding the one or more documents from within the hopper and past the feed wheel.

3. The document processor of claim 2, further comprising:

a first sidewall extending from the base unit, a second sidewall extending from the base unit, and a first divider wall member extending from the base unit, wherein the first divider wall member is arranged between the first sidewall and the second sidewall, wherein the first sidewall and the first divider wall member at least partially forms the hopper, wherein the second sidewall and the first divider wall member at least partially forms an output hopper.

4. The document processor of claim 3, further comprising:

a second divider wall member extending from the base unit, wherein the second divider wall member is arranged between the second sidewall and the first divider wall member for at least partially forming a first output hopper pocket, and a second output hopper pocket.

5. The document processor of claim 4, further comprising:

a pocket selector connected to the base unit, wherein the pocket selector provides means for sorting the one or more documents fed from within the hopper and past the feed wheel into one of the first output hopper pocket and the second output hopper pocket.

6. The document processor of claim 2, wherein the motor further provides:

means for stoking the arm for causing the nudger wheel to impact the one or more documents in the hopper, wherein a number of strokes of the arm is selectively altered to provide the an optimum balance between document alignment and preparation time.

7. The document processor of claim 6, wherein the number of strokes is selectively altered automatically in response to performance of the document processor.

8. The document processor of claim 6, wherein the number of strokes is selectively altered manually in response to an operator selection.

9. The document processor of claim 2, wherein the motor further provides:

means for modulating an angular acceleration of arm.

10. The document processor of claim 1, further comprising:

a spring-loaded flag disposed within the hopper, wherein the spring-loaded flag provides means for urging the one or more documents against the nudger wheel.

11. The document processor of claim 10, further comprising:

a weight attached to the spring-loaded flag, wherein the weight provides means for slowing movement of the spring-loaded flag to its return position in order to permit the one or more documents to have addition time for permitting the one or more documents to become aligned.

12. The document processor of claim 1, further comprising:

electronics disposed within the base unit, wherein the electronics provide means for performing one or more processing actions upon the one or more documents, wherein the one or more processing actions includes one or more of: front and rear image capturing, magnetic ink character recognition reading, optical character recognition reading, endorsing, and bar code reading.

13. The document processor of claim 1, further comprising:

a separator connected to the base unit, wherein the feed wheel and the separator form a document pinch point.

14. The document processor of claim 13, wherein the separator provides:

means for restraining a trailing document of the one or more document that trails a leading document of the one or more documents being fed through the document processor.

15. A document processor for processing one or more documents, comprising:

a base unit forming a hopper; and a feeder-jogger assembly connected to the base unit, wherein the feeder-jogger assembly includes a motor, a shaft extending from and rotatably-connected to the motor, a first one-way clutch directly connected to the shaft, an arm having a first end and a second end, wherein the first end of the arm is directly mounted to the shaft via the first one-way clutch, a first gear directly connected to the shaft, a second gear directly connected to the shaft, a first belt having a first end and a second end, wherein the first end of the first belt is connected to the first gear, a third gear connected to the second end of the first belt, a nudger wheel disposed upon a first drive shaft and connected to the third gear, wherein the nudger wheel is directly connected to the first drive shaft by way of a second one-way clutch; and a spring-loaded flag disposed within the hopper, wherein the spring-loaded flag is biased toward the nudger wheel.

16. The document processor of claim 15, wherein the feeder-jogger assembly further includes a second belt having a first end and a second end, wherein the first end of the second belt is connected to the second gear, a fourth gear connected to the second end of the second belt, a feed wheel disposed upon a second drive shaft and connected to the fourth gear, wherein the feed wheel is connected to the second drive shaft by way of a third one-way clutch.

17. The document processor of claim 16, further comprising:

a separator connected to the base unit, wherein the feed wheel and the separator form a document pinch point.

18. The document processor of claim 17, wherein the separator provides:

means for restraining a trailing document of the one or more document that trails a leading document of the one or more documents being fed through the document processor.

19. The document processor according to claim 15, wherein the motor provides means for rotating the shaft in one of a forward direction, and a reverse direction, wherein the motor momentarily rotates the shaft in the reverse direction to result in the nudger wheel impacting the one or more documents within the hopper for aligning the one or more documents prior to a feeding of the one or more documents from within the hopper and past the feed wheel, wherein after the motor momentarily rotates the shaft in the reverse direction, the motor rotates the shaft in the forward direction to results in the nudger wheel feeding the one or more documents from within the hopper and past the feed wheel.

20. The document processor of claim 19, further comprising:

a first sidewall extending from the base unit, a second sidewall extending from the base unit, and a first divider wall member extending from the base unit, wherein the first divider wall member is arranged between the first sidewall and the second sidewall, wherein the first sidewall and the first divider wall member at least partially forms the hopper, wherein the second sidewall and the first divider wall member at least partially forms an output hopper.

21. The document processor of claim 20, further comprising:

a second divider wall member extending from the base unit, wherein the second divider wall member is arranged between the second sidewall and the first divider wall member for at least partially forming a first output hopper pocket, and a second output hopper pocket.

22. The document processor of claim 21, further comprising:

a pocket selector connected to the base unit, wherein the pocket selector provides means for sorting the one or more documents fed from within the hopper and past the feed wheel into one of the first output hopper pocket and the second output hopper pocket.

23. The document processor of claim 19, wherein the motor further provides:

means for stoking the arm for causing the nudger wheel to impact the one or more documents in the hopper, wherein a number of strokes of the arm is selectively altered to provide the an optimum balance between document alignment and preparation time.

24. The document processor of claim 23, wherein the number of strokes is selectively altered automatically in response to performance of the document processor.

25. The document processor of claim 23, wherein the number of strokes is selectively altered manually in response to an operator selection.

26. The document processor of claim 19, wherein the motor further provides:

means for modulating an angular acceleration of arm.

27. The document processor of claim 15, wherein the spring-loaded flag provides:

means for urging the one or more documents against the nudger wheel.

28. The document processor of claim 27, further comprising:

a weight attached to the spring-loaded flag, wherein the weight provides means for slowing movement of the spring-loaded flag to its return position in order to permit the one or more documents to have addition time for permitting the one or more documents to become aligned.

29. The document processor of claim 15, further comprising:

electronics disposed within the base unit, wherein the electronics provide means for performing one or more processing actions upon the one or more documents, wherein the one or more processing actions includes one or more of front and rear image capturing, magnetic ink character recognition reading, optical character recognition reading, endorsing, and bar code reading.

30. A document processor for processing one or more documents, comprising:

a base unit forming a hopper; and a feeder-jogger assembly connected to the base unit, wherein the feeder-jogger assembly includes a motor, a shaft extending from and rotatably-connected to the motor, a first one-way clutch directly connected to the shaft, an arm having a first end and a second end, wherein the first end of the arm is directly mounted to the shaft via the first one-way clutch, a first gear directly connected to the shaft, a second gear directly connected to the shaft, a first belt having a first end and a second end, wherein the first end of the first belt is connected to the first gear, a third gear connected to the second end of the first belt, a nudger wheel disposed upon a first drive shaft and directly connected to the third gear, wherein the nudger wheel is directly connected to the first drive shaft by way of a second one-way clutch, a second belt having a first end and a second end, wherein the first end of the second belt is connected to the second gear, a fourth gear connected to the second end of the second belt, a feed wheel disposed upon a second drive shaft and directly connected to the fourth gear, wherein the feed wheel is directly connected to the second drive shaft by way of a third one-way clutch, wherein the motor provides means for rotating the shaft in one of a forward direction and a reverse direction, wherein the motor momentarily rotates the shaft in the reverse direction to result in the nudger wheel impacting the one or more documents within the hopper for aligning the one or more documents prior to a feeding of the one or more documents from within the hopper and past the feed wheel, wherein after the motor momentarily rotates the shaft in the reverse direction, the motor rotates the shaft in the forward direction to results in the nudger wheel feeding the one or more documents from within the hopper and past the feed wheel.

31. The document processor of claim 30, further comprising:

a spring-loaded flag disposed within the hopper, wherein the spring-loaded flag provides means for urging the one or more documents against the nudger wheel.

32. The document processor of claim 31, further comprising:

a weight attached to the spring-loaded flag, wherein the weight provides means for slowing movement of the spring-loaded flag to its return position in order to permit the one or more documents to have addition time for permitting the one or more documents to become aligned.

33. The document processor of claim 30, further comprising:

electronics disposed within the base unit, wherein the electronics provide means for performing one or more processing actions upon the one or more documents, wherein the one or more processing actions includes one or more of front and rear image capturing, magnetic ink character recognition reading, optical character recognition reading, endorsing, and bar code reading.

34. The document processor of claim 30, further comprising:

a first sidewall extending from the base unit, a second sidewall extending from the base unit, and a first divider wall member extending from the base unit, wherein the first divider wall member is arranged between the first sidewall and the second sidewall, wherein the first sidewall and the first divider wall member at least partially forms the hopper, wherein the second sidewall and the first divider wall member at least partially forms an output hopper.

35. The document processor of claim 34, further comprising:

a second divider wall member extending from the base unit, wherein the second divider wall member is arranged between the second sidewall and the first divider wall member for at least partially forming a first output hopper pocket, and a second output hopper pocket.

36. The document processor of claim 35, further comprising:

a pocket selector connected to the base unit, wherein the pocket selector provides means for sorting the one or more documents fed from within the hopper and past the feed wheel into one of the first output hopper pocket and the second output hopper pocket.

37. The document processor of claim 20, further comprising:

a separator connected to the base unit, wherein the feed wheel and the separator form a document pinch point.

38. The document processor of claim 37, wherein the separator provides:

means for restraining a trailing document of the one or more document that trails a leading document of the one or more documents being fed through the document processor.

39. The document processor of claim 30, wherein the motor further provides:

means for stoking the arm for causing the nudger wheel to impact the one or more documents in the hopper, wherein a number of stokes of the arm is selectively altered to provide the an optimum balance between document alignment and preparation time.

40. The document processor of claim 39, wherein the number of strokes is selectively altered automatically in response to performance of the document processor.

41. The document processor of claim 39, wherein the number of strokes is selectively altered manually in response to an operator selection.

42. The document processor of claim 30, wherein the motor further provides means for modulating an angular acceleration of arm.

* * * * *

UNITED STATES PATENT AND TRADEMARK OFFICE

CERTIFICATE OF CORRECTION

PATENT NO. : 8,087,660 B2
APPLICATION NO. : 12/176804
DATED : January 3, 2012
INVENTOR(S) : Spall et al.

It is certified that error appears in the above-identified patent and that said Letters Patent is hereby corrected as shown below:

At column 10, claim number 37, line number 37, delete “20” and insert -- 30 --.

Please correct Claim 39 as follows:

At column 10, claim number 39, line number 51, delete the word “stokes” and insert the word -- strokes --.

Signed and Sealed this
Tenth Day of April, 2012

David J. Kappos

David J. Kappos
*Director of the United States Patent and Trademark Office*